United States Patent [19]

Bell, Jr. et al.

[11] 4,089,368

[45] May 16, 1978

[54] FLOW DIVIDER FOR EVAPORATOR COIL

[75] Inventors: William W. Bell, Jr., Marcellus; Rudy C. Bussjager, Minoa, both of N.Y.

[73] Assignee: Carrier Corporation, Syracuse, N.Y.

[21] Appl. No.: 753,657

[22] Filed: Dec. 22, 1976

[51] Int. Cl.[2] ..... F28F 9/26; F25B 39/02

[52] U.S. Cl. ..... 165/139; 62/525; 165/150; 165/178

[58] Field of Search ..... 165/139, 178, 150, 151; 62/524, 525, 526

[56] References Cited

U.S. PATENT DOCUMENTS

| | | | |
|---|---|---|---|
| 2,044,455 | 6/1936 | Witzel | 62/525 |
| 2,068,955 | 1/1937 | Kritzer et al. | 165/151 |
| 2,545,561 | 3/1951 | Spieth | 165/151 |
| 2,917,285 | 12/1959 | Schack | 165/139 |
| 3,142,970 | 8/1964 | Hale | 62/524 |
| 3,941,187 | 3/1976 | Jabsen et al. | 165/175 |

FOREIGN PATENT DOCUMENTS

| | | | |
|---|---|---|---|
| 1,182,322 | 6/1959 | France | 165/150 |

*Primary Examiner*—Charles J. Myhre
*Assistant Examiner*—Sheldon Richter
*Attorney, Agent, or Firm*—J. Raymond Curtin; Robert P. Hayter

[57] ABSTRACT

A flow divider for use in a direct expansion heat exchanger coil as typically utilized in an air conditioning system. The divider is adapted to receive an entering flow of refrigerant from a first circuit and equally distribute the flow into a plurality of leaving circuits. The geometry of the divider is arranged so that the force of gravity acting upon the working fluids passing therethrough is negated thereby enhancing the ability of the divider to produce an equal flow distribution in each of the leaving circuits.

10 Claims, 4 Drawing Figures

FLOW DIVIDER FOR EVAPORATOR COIL

BACKGROUND OF THE INVENTION

This invention relates to a flow divider suitable for use in a direct expansion evaporator coil as typically employed in an air conditioning system and, in particular, to a divider capable of producing a relatively equal flow distribution in each of a plurality of divided flow stream.

In many air conditioning systems, a controlled heat transfer is effective within an evaporator coil by exchanging energy between a media being cooled, typically air, which is passed over the coil surfaces and a working fluid, such as a refrigerant, which is routed through the coil by means of tubular flow circuits. Liquid refrigerant in the evaporator coil absorbs its latent heat of evaporation from the media being cooled and, in the process, is converted to a vapor at a relatively constant temperature. As the refrigerant evaporates, it's volume increases rather dramatically. In order to accommodate for this increase in volume, the circuits may be divided so that one entering refrigerant circuit is split into two or more leaving circuits.

In order to simplify the design of the evaporator, better control the movement of refrigerant through the coil, and enhance the coil's heat transfer characteristic, it is oftentimes highly desirous to produce an equal distribution in the flow of refrigerant directed into each of the divided flow circuits. Obtaining this type of equal distribution without resorting to complex downstream control circuitry has heretofore been a problem in the art. Conventionally, Y-shaped dividers, generally referred to as "sling shots" have been used to divide an entering flow of refrigerant into two or more evaporator circuits while three legged return bends, aptly referred to as "tripods", are used to divert the flow leaving one evaporator circuit into two or more circuits. Although these prior art devices serve to divide a flow of refrigerant as it enters a plurality of circuits, the distribution of working fluids diverted into each of the divided flow streams generally tends to be unequal. When this occurs, steps must be taken downstream of the divider to adjust the circuits and thus correct the system for the unequal split. One important causal factor of this unequal split is the more pronounced effect of gravity upon one of the divided flow streams than the other. This, in turn, causes a greater amount of flow to pass into the more gravity sensitive circuit thus having an adverse effect upon the operation of the evaporator coil.

SUMMARY OF THE INVENTION

It is therefore an object of the present invention to improve direct expansion evaporator coils as typically employed in refrigeration systems.

A further object of the present invention is to provide a flow divider which is relatively insensitive to the forces of gravity.

Yet another object of the present invention is to provide a simple flow divider for use in an evaporator coil which is capable of equally distributing the entering flow into two or more circuits.

These and other objects of the present invention are attained by means of a flow divider suitable for use in a direct expansion evaporator coil having a first incoming flow stream that is divided into one or more leaving flow streams in a manner wherein an equal distribution of the entering flow is passed into each of the leaving flow streams.

BRIEF DESCRIPTION OF THE DRAWINGS

For a better understanding of the present invention as well as other objects and further features thereof, reference is had to the following detailed description of the invention to be read in connection with the accompanying drawings wherein.

DESCRIPTION OF THE PREFERRED EMBODIMENT

Figure 1:
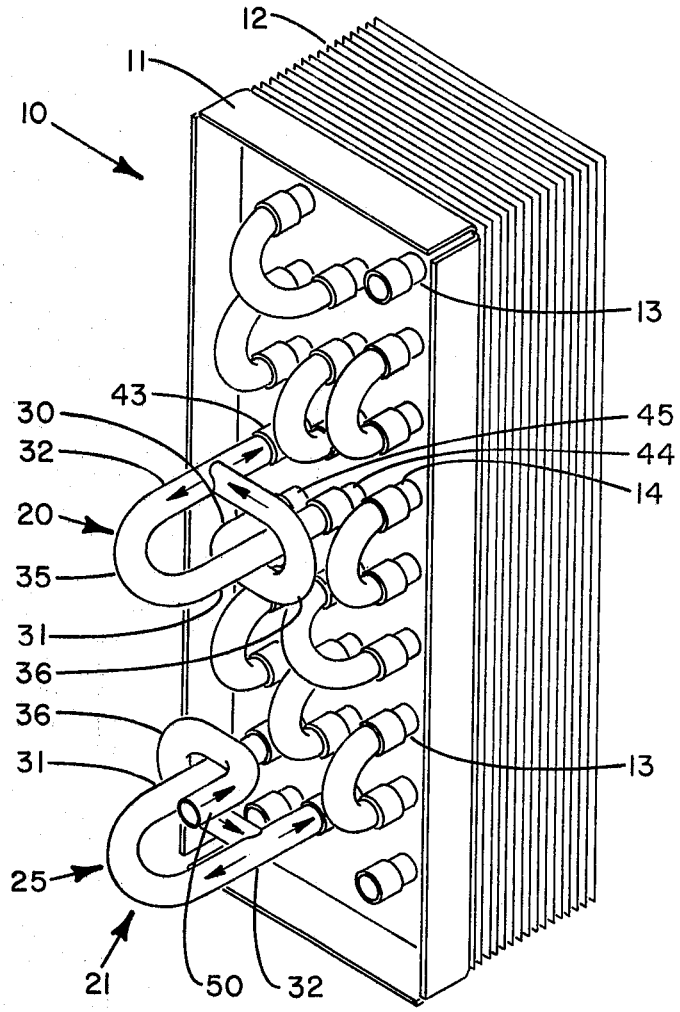
FIG. 1 is a perspective view of a typical evaporator coil as employed in an air conditioning system illustrating the use of two different embodiments of a flow divider utilizing the teachings of the present invention.

Referring initially to FIG. 1, there is shown an evaporator coil 10 containing a number of tubular flow circuits passing therethrough. The coil assembly includes a plurality of plate fins 12 that are stacked and spaced apart parallel alignments between two tube sheets, such as tube sheet 11. The flow circuits are established by a number of parallel aligned rows of tubes passing horizontally through the fin package and the tube sheets. Typically, two tube rows are formed by bending a straight length of tubing into a hairpin configuration. The ends of the hairpins 13 are passed through the fin assembly and brought out of the assembly at a common joint region adjacent to one of the tube sheets. The ends of the tube in the joint region are expanded outwardly to create bell joints 14 capable of receiving in telescoping relationship therein various other circuit components which, when joined together, complete the circuits. The joining of the components is accomplished by any suitable joining technique such as brazing or soldering.

The hairpins are joined by return bends 15 to establish multiple pass circuits passing back and forth through the coil assembly. As pointed out above, refrigerant is normally passed through the circuits while the media being cooled is moved over the coil surfaces. Other circuit components, such as header connectors, cross over tubes, and distributor tubes may also be similarly employed to either interconnect the various circuits or to put the circuits in fluid flow communication with other system components.

As noted above, flow dividers are also used in conjunction with the flow circuits of evaporator coils to accommodate for the expansion of refrigerant as it moves through the various coil circuits. As will be described below, the divider of the present invention can take two basic forms. The first form, as exemplified by circuit divider 20, is arranged to receive an entering flow of refrigerant from a first circuit passing through the evaporator coil and distribute the flow equally into two other circuits. In the second embodiment, as illustrated by flow divider 25, the incoming flow to the divider is directed to the coil from one of the other system components. As it passes through the divider, the incoming flow is broken into two equally distributed flow streams which are discharged directly into two individual coil circuits.

In order to simplify the design of evaporator coils and to more efficiently regulate the movement of the refrigerant therethrough, it is highly desirous to produce an even distribution in the divided flow streams whereby about fifty percent of the entering liquid flow moves into one of the divided circuits while the remaining portion of the flow is passed into a second circuit. Producing such an even distribution in practice, however, has proven to be extremely difficult. As is best illustrated in FIG. 1, the parallel rows making up the various flow circuits of a typical heat exchanger are normally placed in a horizontal position with the various rows being at the different elevations. Most conventional flow splitters, when used in this environment fail to deliver an equal distribution simply because the force of gravity has a greater effect on one of the divided streams than the other. When this occurs, the downstream circuits are adjusted so that a resulting unequal pressure drop is produced that counteracts the unequal flow distribution to restore a balance to the system. In such cases a careful selection of the downstream circuit configuration must be made in order to overcome the adverse effects of gravity upon the coil performance.

The flow divider of the present invention is specifically designed to overcome the unwanted effects of gravity and provide for an equal distribution in each of the divided flow streams. As will be explained in greater detail below, this result is achieved by a relatively simple device that is specifically adapted to negate the gravity force components acting on each of the divided flow streams and which does not require special compensating downstream circuits.

Figure 3:
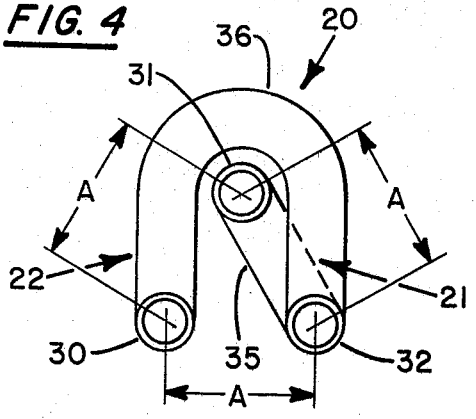
FIG. 3 is a plane view of the flow divider shown in FIG. 2.
Figure 2:
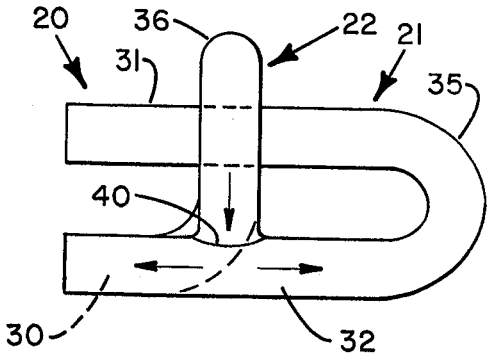
FIG. 2 is an enlarged view of one embodiment of a flow divider shown in FIG. 1.

Circuit flow divider 20 is illustrated in greater detail in FIGS. 2 and 3. The divider consists of two distinct tubular flow sections; a discharge section 21 and an inlet section 22. The discharge section includes two discharge legs 31 and 32 that are maintained in fluid flow communication by means of a 180° tube bend 35. The inlet section includes a single inlet leg 30, which is comparatively shorter than the two discharge legs plus a complex curved leg arranged to place the inlet leg in fluid flow communication with one of the discharge legs, in this case leg 32. As can best be seen in FIG. 1, the complex curved leg is arranged to first turn the inlet flow 90° into a plane generally perpendicular to the two discharge legs. The complex curved leg then makes a tight bend 36 about the second discharge leg 31 prior to its entering the side wall of the other discharge leg 32 at T-joint 40. The second bend has a radius of curvature tight enough to pull the liquid refrigerant in the flow into the plane of the bend thereby negating the effect of the initial 90° bend and insuring that the refrigerant enter the T-joint perpendicular to discharge leg 32.

Figure 4:
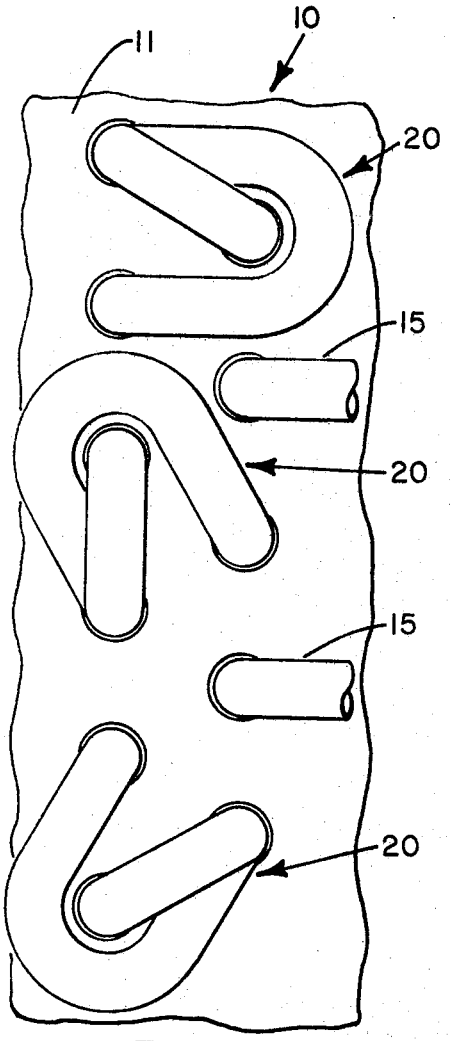
FIG. 4 is an enlarged partial view of an evaporator coil illustrating the flow divider shown in FIG. 2 in a number of different positions.

In many good evaporator coil designs, the various rows of tubes passing through the assembly are positioned equidistance from each other. Accordingly, it is preferred that the legs of the divider 20 also be located at some equidistance "A" (FIG. 3) from each other so that the divider can be operatively associated with any number of tubes passing through the tube sheet. As shown in FIG. 4, the divider can thus be mounted in a number of different positions to provide a great deal of flexibility in circuit design. Because of the construction of the present divider, an equal distribution in the divided flow streams leaving the divider can be maintained when the divider is mounted in any position provided that the tubes passing through the coil assembly are in horizontal alignment.

In assembly, the three legs of the divider are inserted into receiving bells 14 formed in the ends of the tube rows adjacent to the tube sheet 11 and are joined thereto by any suitable joining technique. The legs are thus supported in assembly in a general horizontal position. Refrigerant from a first evaporator coil circuit 45 enters the divider via inlet leg 30. The flow is then turned via a first 90° bend into a plane that is substantially perpendicular to the discharge legs 31 and 32. A second bend 36 is provided to pull the liquid refrigerant abruptly into a vertical plane. After completing the second turn, the flow is directed perpendicularly into the discharge leg 32 via T-joint 40. As can be seen from FIG. 2, the flow directed into leg 32 is maintained substantially perpendicular to the horizontal leg and, regardless of the position of the divider, the force of gravity acting upon the entering flow will always be perpendicular to the flow moving horizontally in either direction through the discharge leg.

The flow passing through the complex bend 36 is discharged directly into leg 32 where the flow is caused to pass in both directions along the tube, as indicated by the arrows, to create two distinct flow streams from the single entering stream. Because of the geometry of the stream, however, the two divided streams have no velocity components in the direction of the incoming stream. Furthermore, because the divided streams are both initially moving in a horizontal direction, the effect of gravity on the divided streams is negated. As a result, a relatively even split in the incoming flow is produced in discharge leg 32 with about half of the total entering flow being discharged from the leg into a first coil circuit 43 and the remainder of the flow being directed around tube bend 35 into discharge leg 31 from which it is directed into a second circuit 44.

The second embodiment of the present invention is illustrated in FIG. 1 as divider 25. As in the case of divider 20, the flow divider 25 consists of a discharge section 21 having two parallel horizontally aligned discharge legs 31 and 32 that are joined by a bend 35. The inlet section to the discharge, however, departs from that utilized in conjunction with flow divider 20 in that the entrance leg 50 is turned away from the tube sheet of the coil to accept an incoming flow of refrigerant directed thereto from another system component. As described in greater detail above, the incoming flow stream is turned 90° and looped about discharge leg 31 prior to its being delivered into the second discharge leg 32. As a result, the flow geometry through the discharge divider device is exactly the same as described above.

While this invention has been described with reference to the detailed description above, the invention is not necessarily confined to these details and shall be covered by the scope of the following claims.

What is claimed is:

1. A heat exchanger having a tubular flow divider suitable for accepting an incoming stream of fluid and equally distributing the flow into two discharge streams including a U-shaped discharge section having two parallel discharge legs being connected at one end by a tube bend, and an inlet section having a straight leg that is in parallel alignment with the discharge legs and a curved leg being arranged to place the inlet leg in fluid communication with one of the discharge legs, the curved leg having a first bend arranged to turn the curved leg into a plane substantially perpendicular to the discharge legs and a second bend in said plane that has a radius of curvature sufficient to hold fluid passing therethrough in said plane whereby the fluid enters the discharge leg substantially perpendicular to the axis of said leg.

2. The heat exchanger of claim 1 wherein the terminal ends of the two discharge legs and the terminal end of the inlet leg lie in a common plane that is substantially parallel with the plane in which said second bend lies.

3. The heat exchanger of claim 1 wherein the inlet leg extends outwardly from the complex bend in a direction opposite that of the discharge legs.

4. The heat exchanger of claim 1 wherein the curved leg of the inlet section enters the wall of said one discharge leg about midway along the length of said discharge leg.

5. The heat exchanger of claim 4 wherein the axial centers of two discharge legs and the axial center of the inlet leg are positioned equidistance from each other.

6. The heat exchanger of claim 5 wherein the radius of curvature of the second bend of the curved leg lies on the axial centering of said other discharge leg.

7. In an evaporator coil having a plurality of horizontally aligned flow circuits passing therethrough, a flow divider for distributing an incoming stream of fluid equally into two of the coil circuits including an elongated tube bend section having two parallelly aligned horizontally extended discharge legs operatively connected to one of the coil circuits, and an inlet section having a horizontally extended inlet leg and a curved leg for placing the inlet leg in fluid flow communication with a first discharge leg, the curved leg having a first bend for turning fluid passing through said inlet leg into a vertical plane and a second bend having a radius of curvature such that the fluid moving through the curved leg is held in said vertical plane whereby the flow entering the first discharge leg contains no velocity components in the direction of the discharge flow developed in the discharge section.

8. The flow divider of claim 7 wherein said second bend has a radius of curvature center upon the axial centerline of the second discharge leg.

9. The flow divider of claim 7 wherein the inlet leg of said inlet section is operatively connected to another of the coil circuits.

10. The flow divider of claim 7 wherein said inlet leg is arranged to deliver a fluid into said evaporator from a remote source.

* * * * *